US005341276A

United States Patent [19]

Shen

[11] Patent Number: 5,341,276

[45] Date of Patent: Aug. 23, 1994

[54] TRACK-MOUNTED LIGHTING FIXTURE

[76] Inventor: Wei H. Shen, 6F, No. 416, Sec. 4, Jen Ai Rd., Taipei, Taiwan

[21] Appl. No.: 80,719

[22] Filed: Jun. 24, 1993

[51] Int. Cl.[5] ..... H01R 33/00

[52] U.S. Cl. ..... 362/226; 362/147; 362/404; 439/110; 248/343

[58] Field of Search ..... 362/147, 148, 226, 249, 362/250, 269, 285, 404, 418; 439/110, 116, 119, 207; 248/342, 343, 344

[56] References Cited

U.S. PATENT DOCUMENTS

| | | | |
|---|---|---|---|
| 3,451,035 | 6/1969 | Baldwin | 362/226 |
| 3,987,992 | 10/1976 | Foflygen | 248/342 |
| 4,569,568 | 2/1986 | Agabekov | 439/110 |
| 4,852,840 | 8/1989 | Marks | 362/147 |
| 5,154,509 | 10/1992 | Wulfman et al. | 362/226 |

FOREIGN PATENT DOCUMENTS

| | | | |
|---|---|---|---|
| 4123711 | 4/1992 | Japan | 362/404 |

*Primary Examiner*—Ira S. Lazarus
*Assistant Examiner*—Y. Quach
*Attorney, Agent, or Firm*—Browdy and Neimark

[57] ABSTRACT

A track-mounted lighting fixture including a track mounting device having a split extended from a horizontal top mounting channel to an outer thread thereof, a lock nut threaded onto the outer thread, and a connector to connect a lamp holder to the track mounting device, whereby the pitch is enlarged for allowing the track mounting device to be mounted on an overhead track as the lock nut is turned in one direct; the pitch is shortened for allowing the track mounting device to be firmly retained to the overhead track as the lock nut is turned in the reversed direction.

1 Claim, 4 Drawing Sheets

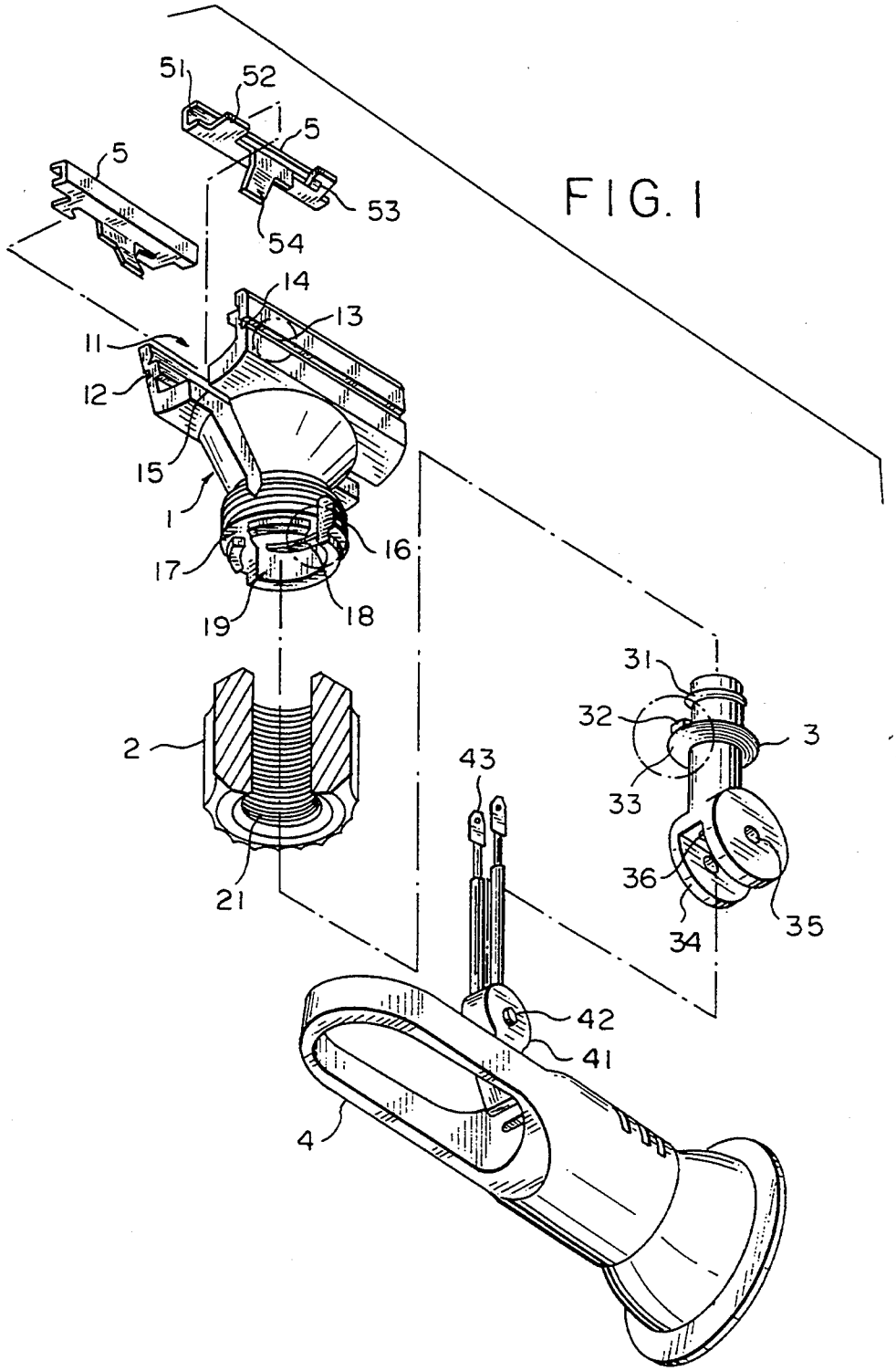
FIG. 1
FIG. 1A
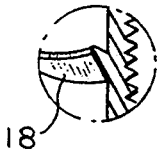
FIG. 1B
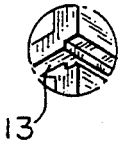
FIG. 1C
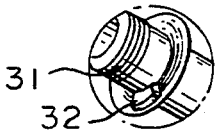

TRACK-MOUNTED LIGHTING FIXTURE

BACKGROUND OF THE INVENTION

The present invention relates to a track-mounted lighting fixture for mounting a lamp on an overhead track by means of the control of a lock nut.

Various track-mounted lighting fixtures have been disclosed, and have appeared on the market. These track-mounted lighting fixtures commonly have a complicated mounting mechanism for mounting on an overhead track. Therefore, these track-mounted lighting fixtures are commonly difficult to install.

SUMMARY OF THE INVENTION

The present invention eliminates the aforesaid problem. It is therefore the principal object of the present invention to provide a track-mounted lighting fixture which is easy to install. According to the preferred embodiment, the track-mounted lighting fixture comprises a track mounting device having a split channel controlled by a lock nut. Turning the lock nut on the track mounting device causes the split channel to extend the pitch between two opposite side walls thereof for allowing it to be conveniently mounted on an overhead track. As the lock nut is turned in the reversed direction, the pitch between the two opposite side walls of the split channel is shortened, and therefore the track mounting device becomes firmly retained to the overhead track.

BRIEF DESCRIPTION OF THE DRAWINGS

FIG. 1 is an exploded view of a track-mounted lighting fixture according to the preferred embodiment of the present invention with FIGS. 1A, 1B and 1C being enlarged views of the circled areas of FIG. 1;

DETAILED DESCRIPTION OF THE PREFERRED EMBODIMENT

Figure 2:
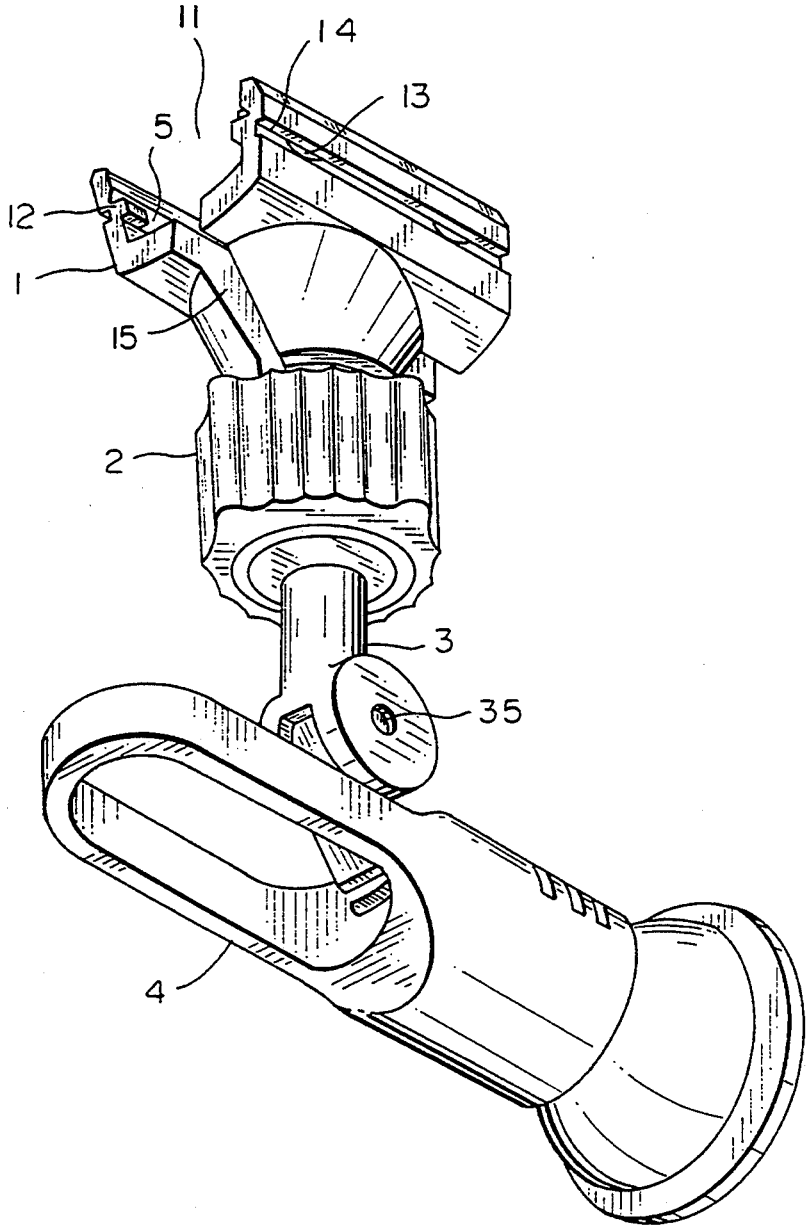
FIG. 2 is a perspective view of the track-mounted lighting fixture.
Figure 3:
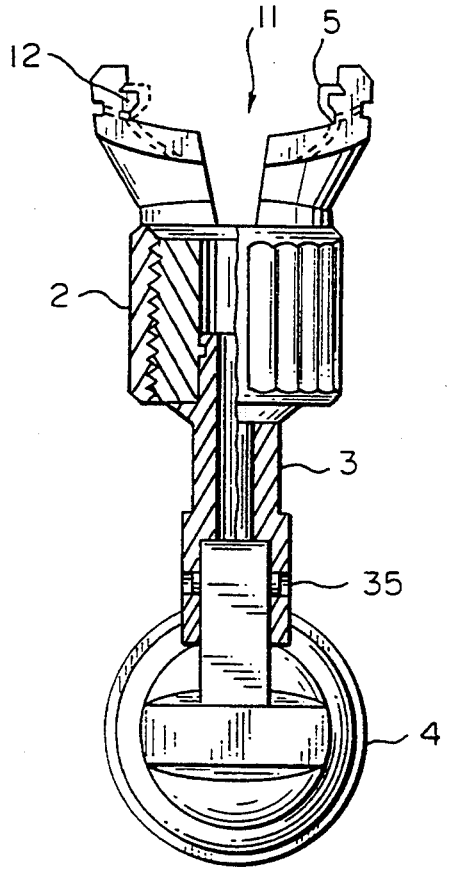
FIG. 3 is a sectional plain view of the track-mounted lighting fixture.

Referring to FIG. 2, a track-mounted lighting fixture in accordance with the preferred embodiment of the present invention is generally comprised of a track mounting device 1, a lock nut 2, a tubular connector 3, a lamp holder 4, and two contact metal plates 5.

Referring to FIGS. 1 and 2 again, the track mounting device 1 comprises a horizontal top channel 11 having two longitudinal inside ribs 12 and two longitudinal outside grooves 14 on two opposite side walls thereof and pairs of opposite holes 13 through the longitudinal grooves 14, a bottom stub screw tube 16 vertically extended from the top channel 11 in the middle and having locating hole 17 and an inside flange 18 inside a bottom hole 19 thereof. A split 15 is made through the longitudinal center line of the top channel 11 and part of the bottom stub screw tube 16. The lock nut 2 has an inside thread 21 threaded onto the bottom stub screw tube 16 of the mounting device 1 and turned in either direction to adjust the pitch between the two opposite side walls of the channel 11. The tubular connector 3 comprises an annular groove 31 around a top end thereof inserted into the bottom hole 19 of the bottom stub screw tube 16 and engaged with the inside flange 18, a locating projection 32 fitted into the locating hole 17, a collar 33 blocked over the orifice of the bottom hole 19, and two parallel lugs 34 spaced by a longitudinal center through hole 36 and having a respective center axle hole 35 aligned with each other. The lamp holder 4 comprises a mounting block 41 having two stub axles 42 aligned on two opposite sides thereof respectively fitted into the center axle hole 35 on either lug 34, and two contact terminals 43 inserted through the longitudinal center through holes 36 and then connected to the two contact metal plates 5. The two contact metal plates 5 are respectively fastened inside the channel 1 of the track mounting device 1, each having longitudinal clamping portion 51 clamped on either longitudinal inside rib 12, two spaced hooked portions 52;53 respectively extended out of respective holes 13 on either side wall of the channel 11 and hooked on the respective longitudinal outside groove 14, and a contract portion 54 connected to either contact terminal 43 of the lamp holder 4.

Figure 4:
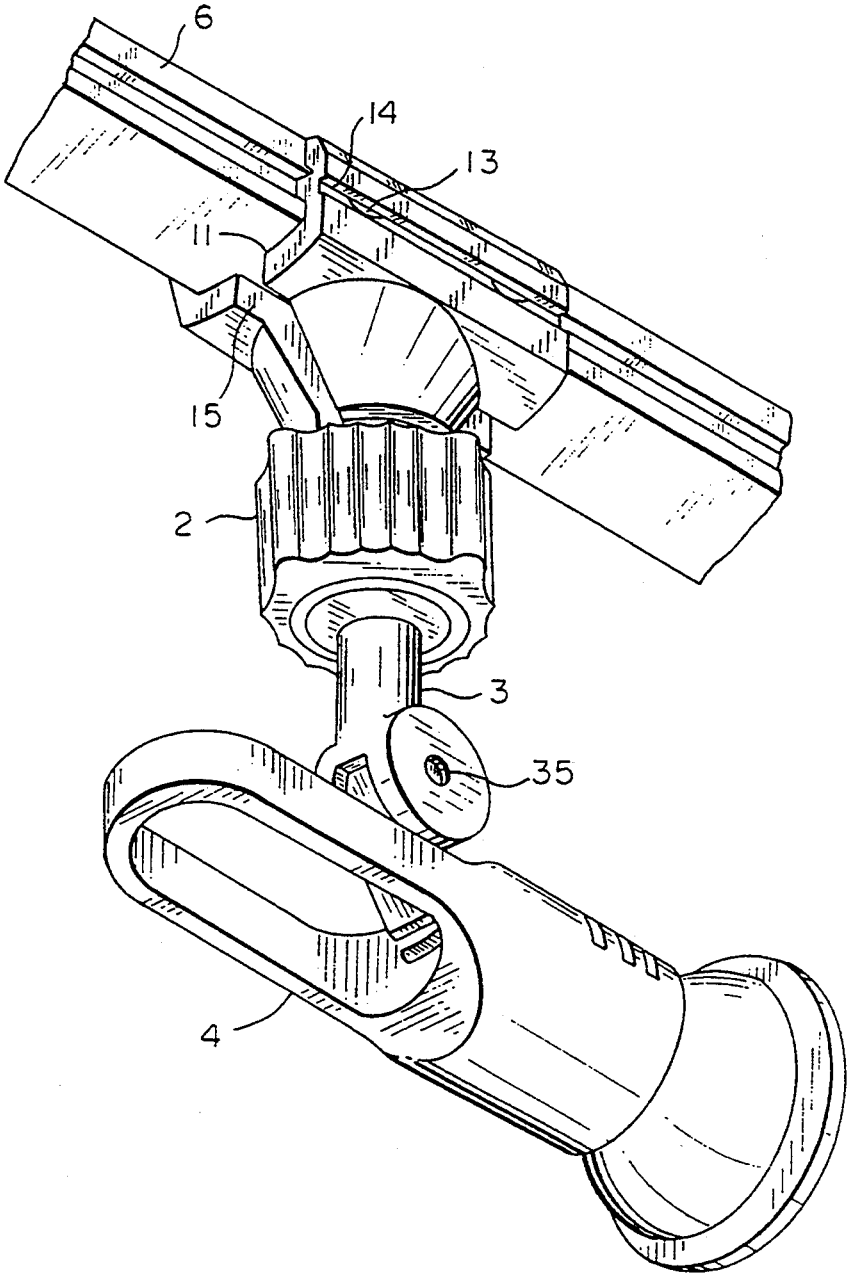
FIG. 4 is an installed view showing the track-mounted lighting fixture mounted on an overhead track.

Referring to FIG. 4, the lock nut 2 is loosened from the bottom stub screw tube 16 to extend the pitch between the two opposite side walls of the channel 11 of the track mounting device 1 for allowing the channel 11 to be mounted on an overhead track 6. When mounted, the lock nut 2 is screwed tight to lock the channel 11 on the track 6.

What is claimed is:

1. A track-mounted lighting fixture comprising:

a track mounting device for mounting on an overhead track, said track mounting device comprising a horizontal top channel having two opposite side walls, two longitudinal inside ribs respectively made on the two opposite side walls on the inside, two longitudinal outside grooves respectively made on the two opposite side walls on the outside, pairs of opposite holes made through said longitudinal grooves, a bottom stub screw tube vertically extended downward from said top channel, said bottom stub screw tube having a locating hole through a peripheral wall thereof in communication with a center bottom hole thereof, an inside flange disposed inside the center bottom hole, and split made through said top channel and part of said bottom stub screw tube in the middle;

a lock nut threaded onto said bottom stub screw tube of said track mounting device and turned in either direction to adjust the pitch between the two opposite side walls of said top channel;

a lamp holder having a mounting block with two stub axles aligned on two opposite sides thereof, and two contact terminals;

a tubular connector to connect said lamp holder to said track mounting device, said tubular connector comprising an annular groove around a top end thereof inserted into the center bottom hole of said bottom stub screw tube and engaged with the inside flange inside said bottom stub screw tube, a locating projection fitted into the locating hole on said bottom stub screw tube, a collar blocked over the center bottom hole of said bottom stub screw tube, two spaced eye lugs to which said stub axles of said mounting block of said lamp holder are pivotably connected, and a longitudinal center through hole through which the contact terminals of said lamp holder insert; and two contact metal plates, each contact metal plate having longitudinal clamping portion clamped on either longitudinal inside rib on said top channel, two spaced hooked portions respectively extended out of respective holes on either side wall of said top channel and hooked on the respective longitudinal outside groove, and a contract portion connected to either contact terminal of said lamp holder.

* * * * *